US005509151A

United States Patent [19]

Fireman et al.

[11] Patent Number: 5,509,151

[45] Date of Patent: Apr. 23, 1996

[54] LOCKABLE TWO FRAME CONVERTIBLE SOFA BED

[75] Inventors: Robert Fireman, 785 W. End Ave., New York, N.Y. 10025; Ralph Rosenow, Corinth, Miss.

[73] Assignee: Robert Fireman, New York, N.Y.

[21] Appl. No.: 164,443

[22] Filed: Dec. 9, 1993

[51] Int. Cl.[6] ..... A47C 17/16

[52] U.S. Cl. ..... 5/37.1; 5/52; 5/47

[58] Field of Search ..... 5/37.1, 47, 41, 5/43, 48, 52

[56] References Cited

U.S. PATENT DOCUMENTS

| | | | |
|---|---|---|---|
| 715,114 | 12/1902 | Mooers . | |
| 1,982,930 | 12/1934 | Russo | 5/37 |
| 2,244,470 | 6/1941 | Neunherz | 5/38 |
| 2,294,475 | 9/1942 | McAllister | 5/47 |
| 2,769,987 | 11/1956 | Thal | 5/37 |
| 3,634,893 | 1/1972 | Hern et al. | 5/37 |
| 4,642,823 | 2/1987 | Wiggins | 5/47 |
| 4,829,611 | 5/1989 | Fireman et al. | 5/47 |
| 4,875,244 | 10/1989 | Tremblay | 5/37 |
| 4,996,730 | 3/1991 | Fireman et al. | 5/37 |
| 5,083,333 | 1/1992 | Newton | 5/37 |
| 5,170,519 | 12/1992 | Meade | 5/37.1 |

*Primary Examiner*—Alexander Grosz
*Attorney, Agent, or Firm*—Auslander & Thomas

[57] ABSTRACT

A two frame sofa bed recliner has a seat frame and back frame. The frames are elevated from the floor on supports. The frame ends are linked, overlapped, interengaging the seat frame with the back frame, enabling a simple conversion reconversion process from sofa bed to recliner. In recliner position the back frame tilts rearward on its end. The back frame is interlocked with the seat frame locked by a detent, retaining means and a second detent in a guide. Conversion and reconversion are effected by rotating the interlocked unit on to the back frame supports, disengaging the seat frame and back frame, then lowering the seat frame to the floor on the supports and interlocking the frames. For reconversion the process is reversed. A removable arm rest is attachable.

11 Claims, 6 Drawing Sheets

FIG. 1
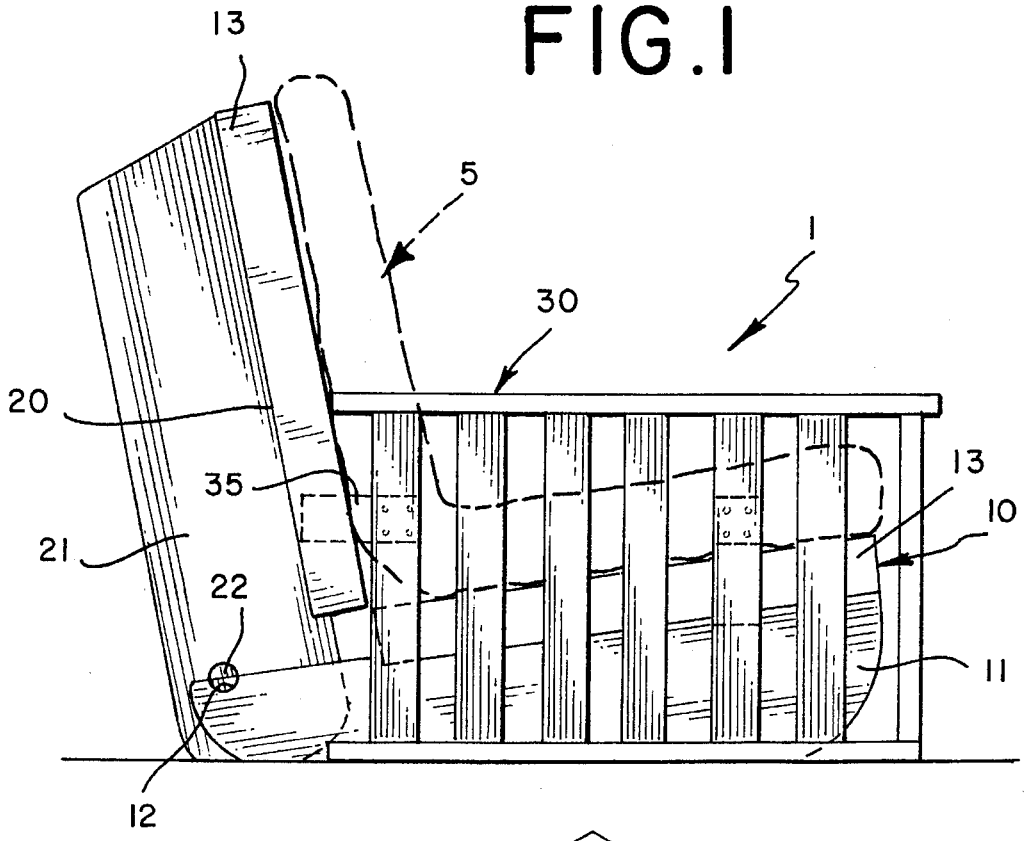
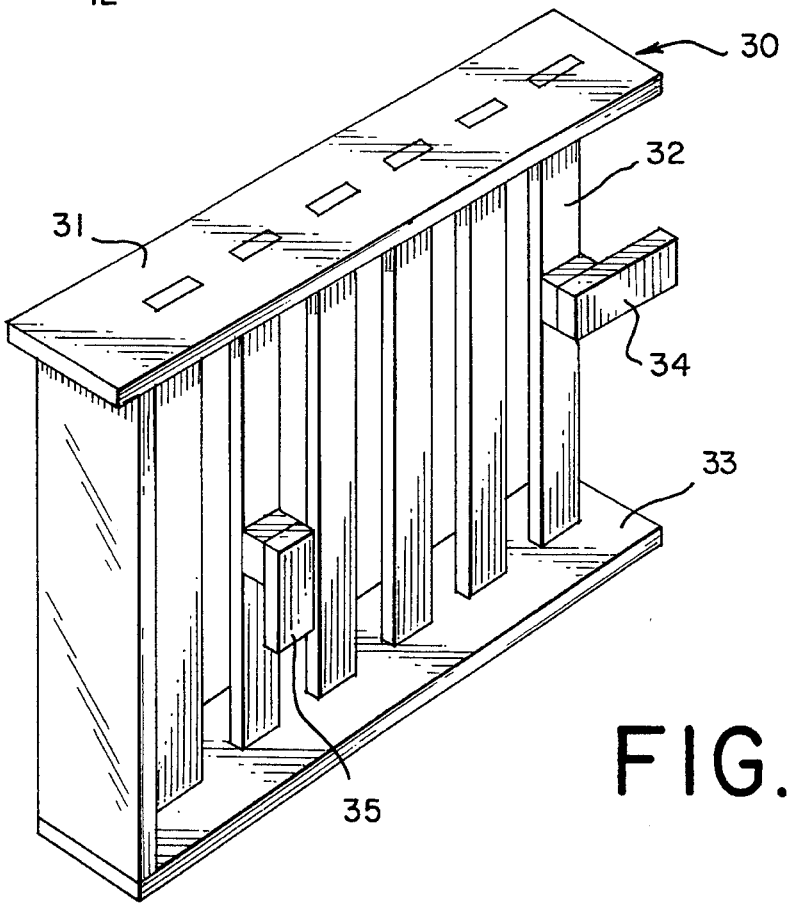
FIG. 2

FIG.3
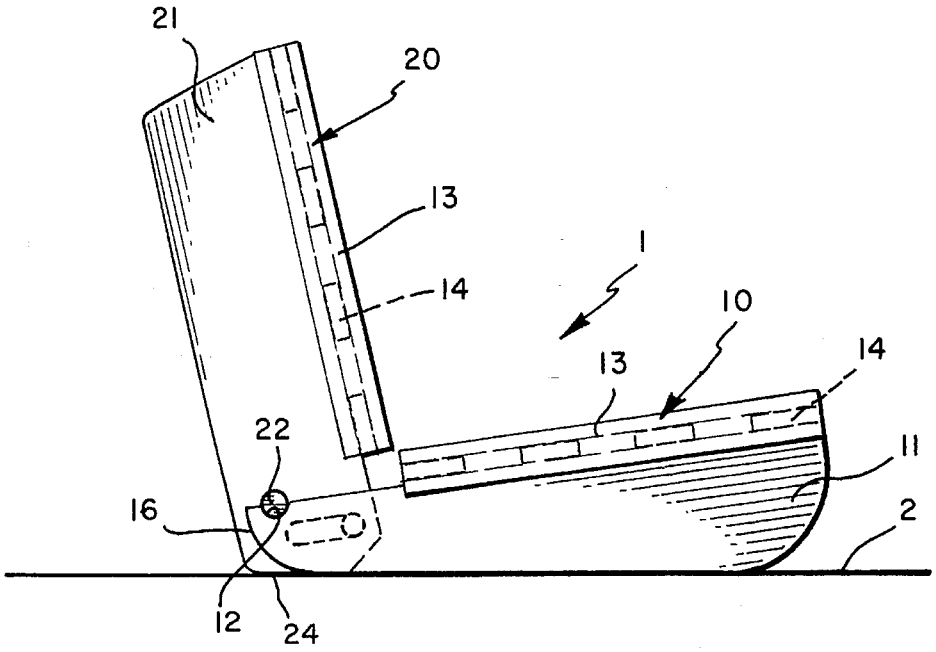
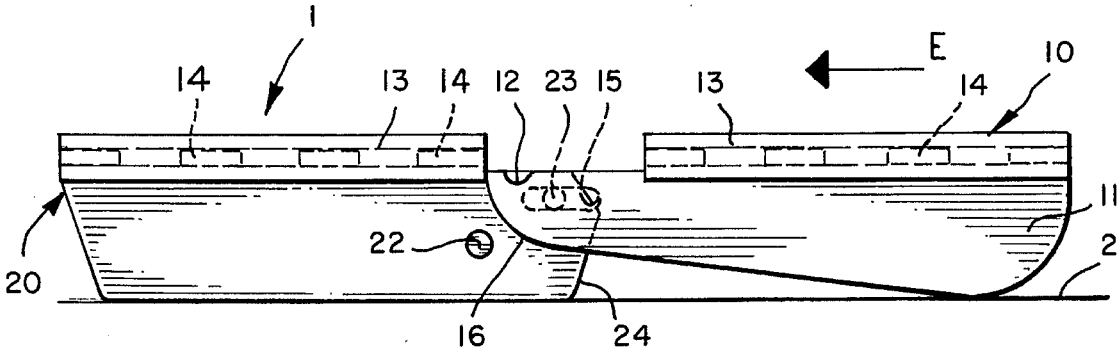
FIG.7

LOCKABLE TWO FRAME CONVERTIBLE SOFA BED

BACKGROUND OF THE INVENTION

The present invention is a two frame assembly sofa bed recliner having a simple interlock between the seat frame assembly and the back frame assembly. The sofa bed recliner has removable arm rests.

The present invention is a unique combination of many elements including some known in the art to provide a inexpensive to produce, easy to use, space saving, sturdy light weight, two frame assembly, sofa bed recliner preferably made of wood with an improved structure and ease of conversion and reconversion over the prior art.

In converting from recliner to a sofa bed it is preferable to have the arm rests disengaged. To convert from recliner to a sofa bed the engaged back frame assembly and seat frame assembly are moved upward from the recliner position. The back frame assembly once horizontal on the floor is unlinked from the seat frame assembly allowing the seat frame assembly to be lowered to a horizontal position and locked against jackknifing. The structure has the advantage of being able to simply interact to transform from recliner to sofa bed.

The arm rests are engagable to the back frame assembly and seat frame assembly once the sofa bed recliner is in recliner position.

The seat frame assembly and back frame assembly are pivotally linked free of any main frame and when in horizontal position support themselves elevated from the floor.

A simple system is provided for reconverting the sofa bed to recliner position. The seat frame assembly is pulled backward disengaging it from its locked position, then lifted to a substantially vertical position. The seat frame assembly and back frame assembly are then interlockable for simultaneous rotation to recliner position.

In a preferred embodiment of the present invention, the length and width of the back frame assembly and the seat frame assembly are such that, when opened into a sofa bed horizontal position, the bed portion is like a full double bed or larger.

The present invention is particularly adapted for use with a futon. Futons have become popular, offering the advantage of convertible structure adaptable for both sitting and sleeping. The present invention acts as a support structure for a futon, having the combined advantage of being a sturdy a sofa bed and recliner.

The present invention has the advantage of the space saving of a futon supported on a structure, which also saves space. The futon serving as a recliner cushion and as a mattress. The simplicity of the structure is economical without sacrificing utility. As a recliner there is no separate main frame, as a sofa bed the seat frame assembly and back frame assembly are properly supported without special supporting parts.

The elements are simplified over the prior art, combined and improved to provide a simple to construction, inexpensive to produce, easy to use two frame assembly sofa bed recliner.

The present invention also is a simple alternative for U.S. Pat. No. 4,829,611. The sofa bed recliner provides an inexpensive simple means for the seat frame assembly and back frame assembly to interengage to easily convert and reconvert to a sofa bed position and to a recliner position.

Lifting of the seat frame assembly to a substantially vertical position enables easy interengaging of the seat frame assembly and back frame assembly for reconversion. Then the interengaged frame assemblies are returnable to the recliner position by a downward rotation. In reconversion the interengaged seat frame assembly and back frame assembly are rotated upward again from the recliner position, then the seat frame assembly is disengaged from the back frame assembly and moved downward.

The structural simplicity is enabled by a slot in the seat frame assembly and the configuration of the bases of the seat frame assembly and back frame assembly and the slot in the seat frame assembly which enables locking in both recliner and sofa bed positions.

DESCRIPTION OF THE PRIOR ART

Annexed hereto is Form PTO-1449 and copies of the patents cited therein.

The prior art is replete with complex two piece structures for sofa beds mounted on main frames where the seat frame and back frame may be laid flat for use as a bed. Exemplary of such structures are U.S. Pat. No. 2,796,987 and U.S. Pat. No. 1,982,930, where complex structures convert the back frame of the a sofa bed recliner from the recliner to a usable bed.

A relatively simple structure, as disclosed in U.S. Pat. No. 715,114 still requires support arms and an awkward pushing to have the seat frame and back resume their prior position and does not have the uncomplicated engaging means of the present invention.

U.S. Pat. No. 4,642,823 discloses a sofa bed recliner with a seat frame and back frame mounted on a base. The back frame has support arms. The seat frame and back frame have a complex tether spring and detent mechanism, which enables a seat frame and back frame interlock. The seat frame and back frame also have a complex interlock when in the horizontal position, so that there is no likelihood of jackknifing.

U.S. Pat. No. 4,875,244 discloses another interlock system for reconverting a main frame wooden sofa bed recliner including guide means and a bell like detent.

U.S. Pat. No. 3,634,893 discloses a metal track system for a hinged three piece sofa bed recliner with a pivotable free floating bell shaped detent interactable with a metal reaction plate. A support arm for the back frame enables conversion of the sofa bed, including a main frame, from a sofa bed to a recliner. The seat frame is supported on legs.

U.S. Pat. No. 2,244,470 discloses a sofa bed on a low main frame with a back having a bracket to provide a two position lock for a back frame. The back frame has a hinged support and a typical wheel arrangement. The back frame has a pivot stud with a notch to engage a separate bracket spaced from the main frame by means of rivets and a collar. The bracket has a right angulated projection for receiving the notch and a vertical guide for receiving the pivot. All locking and movement is an interaction between the bracket and the notched pivot.

U.S. Pat. No. 4,829,611 provides a pivotable detent for interlocking a main frame mounted seat frame and back frame. The patent discloses a complex multi groove guiding system in an end support leg for the seat frame and back frame and means for locking against jackknifing when the wooden sofa bed recliner is in its horizontal position.

U.S. Pat. No. 2,294,475 provides a pivotable metal plate set for interlocking a main frame mounted seat frame and back frame. The patent discloses a complex multi groove guiding system and a groove for in an end support.

U.S. Pat. No. 5,083,333 discloses a sofa bed recliner mounted on a base. The back frame has support arms. The seat frame and back frame have complex ends with grooves and notches and pins which enable a seat frame and back frame interlock. The seat frame and back frame also have an interlock when in the horizontal position, so that there is no likelihood of jackknifing. There are grooves and guide followers in the end frames enabling the conversion and reconversion. A camber on the back frame's end plate guides pins to selected lock notches enabled by the seat frame's end plate groove.

A BRIEF SUMMARY OF THE INVENTION

The present invention is a simple convertible wooden sofa bed having only a seat frame assembly and back frame assembly. The frame assemblies are are pivotally linked at extending portions which overlap, for the converting and reconverting from sofa bed to recliner. The seat frame assembly and back frame assembly include wide support beams which serve to elevate them from the floor. The wide support beam for the back frame assembly elevates it from the floor when the sofa bed recliner is in sofa bed horizontal position or during reconversion. The support beams overlap and link the back frame assembly and end frame assembly with interactive pivots, pins, a groove and a notch at their overlap portions. The overlap portions interlock and can interlock to prevent jackknifing when the sofa bed recliner is in horizontal position.

From the recliner position the seat frame assembly and the back frame assembly may be rotated backward so that the back frame assembly rests on the floor for conversion from recliner to sofa bed horizontal position and reconversion back to recliner position.

In a preferred embodiment detachable arm rests are optionally engagable with the sofa bed recliner of the present invention for additional comfort and convenience.

According to the present invention, a sofa bed recliner has a seat frame and back frame. Each frame has supports. The supports have portions extending beyond the frame portions. The extending portions are overlapping and are interactively engaged There is a detent on the back frame extending portions, a retainer on the seat frame extending portions, and interactive guides and a second detent between the extending portions of each frame.

The interactive engagement may be brought about by first and second detents on the back frame extending portions and a retainer and guide on the seat frame extending portions or the interactive engagement may include interactive interlocking engagable when the sofa bed recliner is in sofa bed position.

The interactive interlocking system may include an interactive guide and a second detent between the extending portions or there may be extending portions and a guide on the seat frame extending portions.

The interactive guide may be a groove and the retainer may be a declivity. The seat frame support may have a front portion and a rear portion tapered down from front to rear and the seat frame extending portion may have a bearing surface such as a camber. One end of the back frame support may be an angulated portion to hold the back frame tilted rearward when back frame rests on the floor when the sofa bed recliner is in recliner position.

The frame portions may have slats.

The sofa beg recliner may include a removable arm rest engagable with the back frame and seat frame or their slats. The arm rests may have detents.

Although such novel feature or features believed to be characteristic of the invention are pointed out in the claims, the invention and the manner in which it may be carried out may be further understood by reference to the description following and the accompanying drawings.

BRIEF DESCRIPTION OF THE DRAWING

FIG. 1 is a left side elevation of the sofa bed recliner in recliner position, with a futon and with an arm rest.

FIG. 2 is an isometric view of the inside of arm rest of FIG. 1.

FIG. 3 is a side elevation of the sofa bed recliner of FIG. 1, without an arm rest and futon.

FIG. 7 is a side elevation of FIG. 6 showing the fourth step of interlocking the seat frame assembly and back frame assembly in horizontal position.

Referring now to the figures in greater detail, where like reference number denote like parts in the various figures.

DETAILED DESCRIPTION

Figure 4:
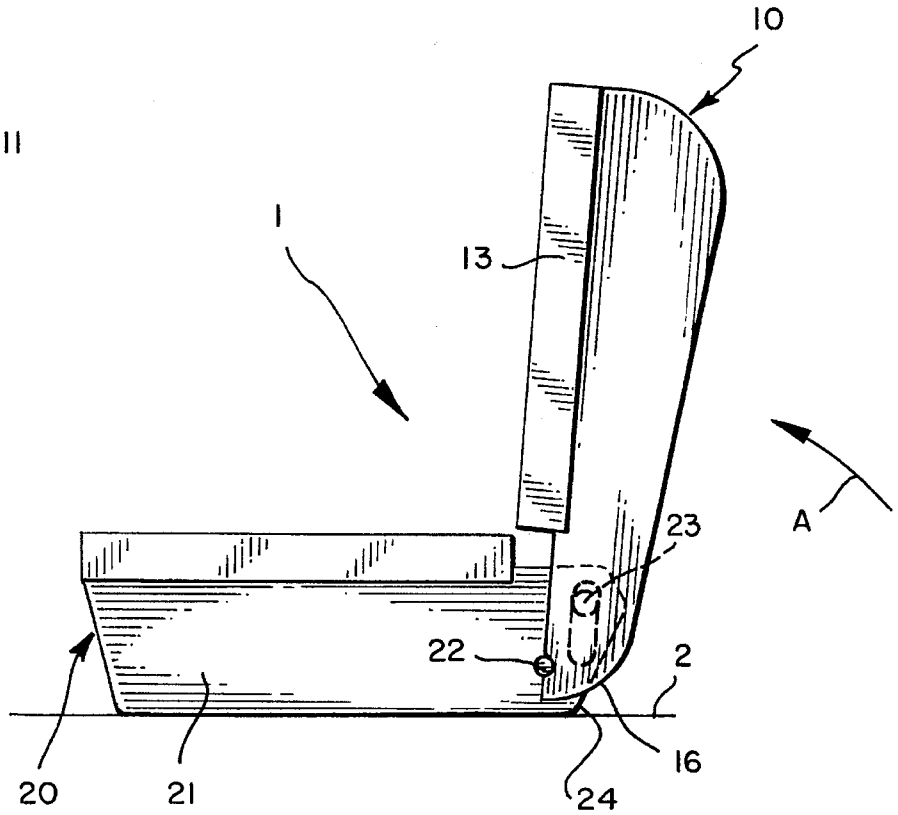
FIG. 4 is a side elevation of the sofa bed recliner of FIG. 3, with the back frame assembly rotated to rest en the floor in the first step of conversion to a sofa bed horizontal position.

The description of the figures includes description of one side of the sofa bed recliner 1, it being understood that the parts are symmetrically distributed or mirror imaged throughout the sofa bed recliner 1.

The sofa bed recliner 1, as shown in the figures, is primarily concerned with use with a futon 5.

The sofa bed recliner 1 is shown in FIG. 1 in recliner position. There is a seat frame assembly 10, a back frame assembly 20 and an arm rest 30. The seat frame assembly 10 includes a support beam 11 upon which it is mounted. There are end rails 13 on the seat frame assembly 10. The seat frame assembly 10 includes slats 14 as can best be seen in FIG. 8.

The arm rest 30 as shown in FIG. 2 has a top portion 31 and a base 33. The top portion 31 and base 33 are joined by slats 32. The rear most slat 32 includes a horizontal detent 34. A vertical detent 35 on forward slat 32. The detents 34 and 35 are engagable between slats 14 of the seat frame assembly 10 and back frame assembly 20 respectively to firmly hold the arm rest 30 in position.

As shown in FIG. 3, sofa bed recliner 1 is in normal recliner position. The seat frame 10 is supported on support beam 11. The back frame assembly 20 is supported on support beam 21. As can best been in FIG. 8, the seat frame assembly 10 and back frame assembly 20 have end rails 13, spaced apart by slats 14. Intermediate support beams 6 rigidify the respective center portions of the seat frame assembly 10 and back frame assembly 20.

The support beam 21 includes a pin 22. As can best be seen in FIG. 9, the support beam 11 includes a groove 15. A pin 23 on the support beam 21 is engaged in the groove 15. The pin 22 on the support beam 21 is engaged in a declivity 12 in the support beam 11.

Operation

In use, the sofa bed recliner 1 with the futon 5, functions as complete unit, as shown in FIG. 3 in recliner position.

The support beam 11 elevates the seat frame assembly 10 to a comfortable distance above the floor 2. In use the thickness of the futon 5 adds to the natural height above the floor 2 for convenience and comfort.

The support beam 11 is tapered backwards, effecting a recliner position of the sofa bed recliner 1 with the seat frame assembly 10 on the floor 2 and the back frame assembly 20 erect. The support beam 21, supporting the back frame assembly 20, has substantially parallel longitudinal edges, as distinguished from the taper of the support beam 11. A pin 22, which may be a dowel in support beam 21, is engagable in a mating declivity 12 in support beam 11.

Figure 9:
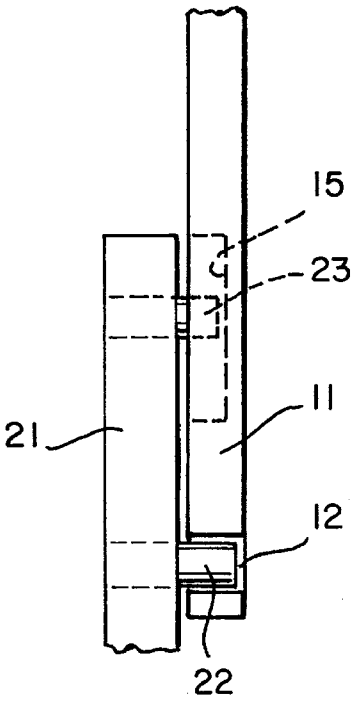
FIG. 9 is a detail front elevation viewed from the left of FIG. 4 showing the seat frame support beam and back frame support beam before disengagement.

As can be seen in FIG. 9, the support beam 21 includes a pin 23, which may be dowel, which is engaged in a groove 15 on the inside of the support beam 11.

As shown in FIG. 3, the inner end 24 of the support beam 21 is angulated and rests on the floor 2, providing the back frame assembly 20 with a rear tilt, commensurate with a recliner position. The back frame assembly 20 is held in position by the combination of the pin 22 and the pin 23, which prevents the back frame assembly 20 from rotating out of control to a horizontal position. The symmetry of the other support beams 11 being outside the support beams 21 maintains the pins 22 and 23 from disengagement.

The uniform width of the support beam 21 is equal to the width of the widest portion of the support beam 11. Thus, as can be seen in FIG. 7, when the sofa bed recliner 1 is in horizontal position, slats 14 of the seat frame assembly 10 and back frame assembly 20 are parallel to the floor 2.

The steps in the conversion and reconversion can be seen in FIGS. 4 through 7.

In FIG. 4, the entire sofa bed recliner 1 as shown in FIG. 3 in recliner position, is rotated in the direction of arrow A, lifting the seat frame assembly 10 and rotating the back frame assembly 20 to rest on the floor 2.

Figure 5:
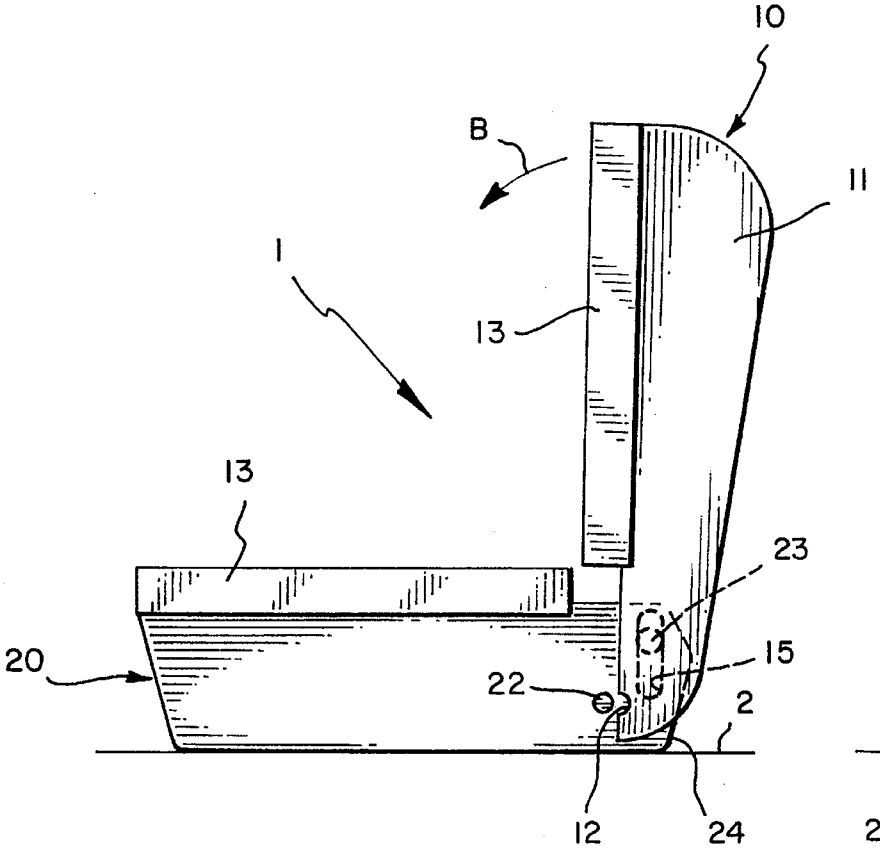
FIG. 5 is a side elevation of FIG. 4 showing the second step, the release of the seat frame assembly.
Figure 6:
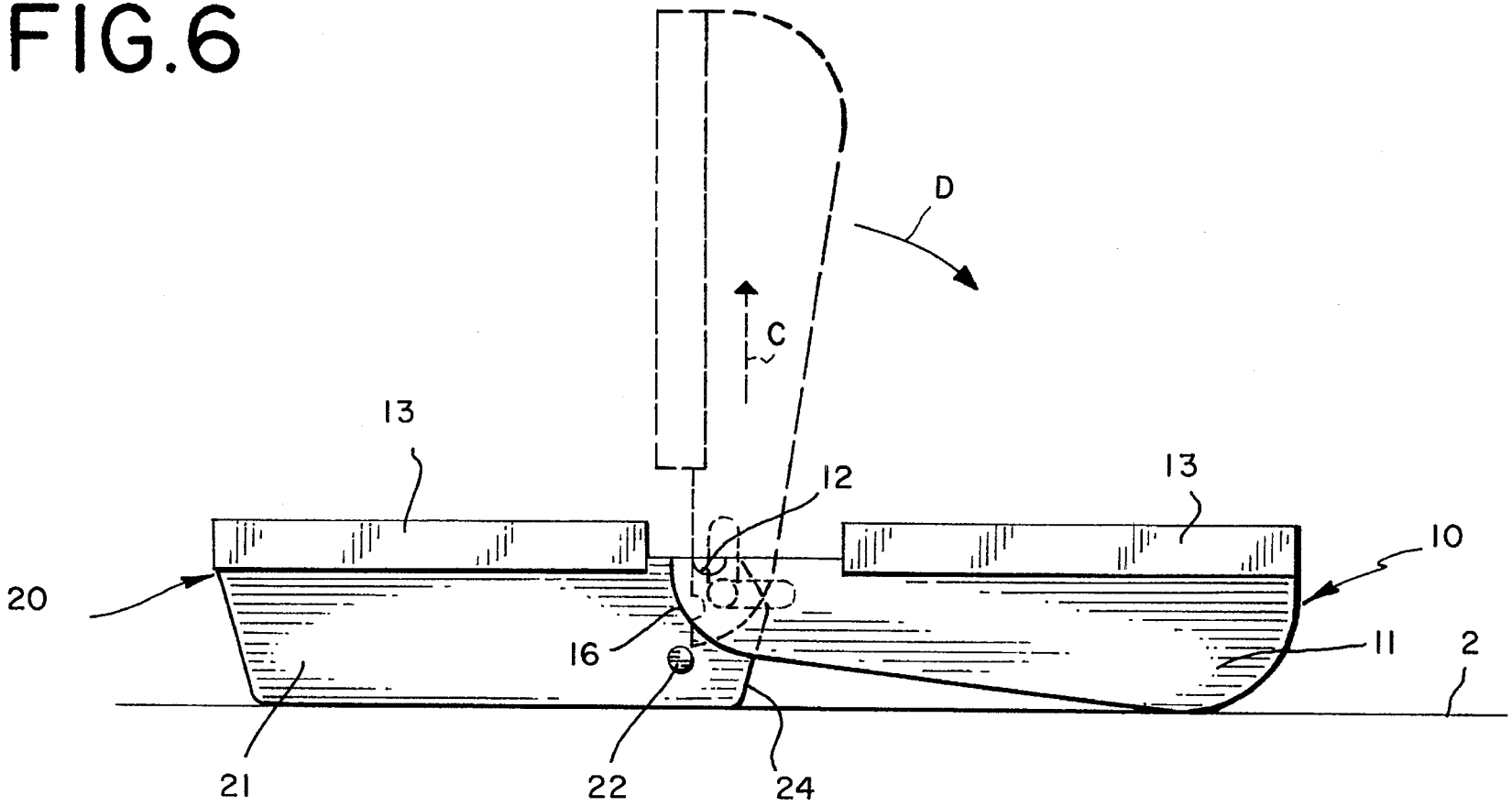
FIG. 6 is a side elevation of FIG. 5 showing the third step, the rotation of the seat frame assembly to horizontal position.

As shown in FIG. 5, a small movement of the seat frame assembly 10 in the direction of arrow B disengages the pin 22 from the declivity 12. The rotation is about the pin 23 as a fulcrum. Once the pin 22 is out of the declivity 12, a small movement, as shown in FIG. 6, in the direction of arrow C, release the interlocking engagement of seat frame assembly 10 and back frame assembly 20, so that the seat frame assembly may be freely rotated in the direction of arrow D to horizontal position, pivoting on pin 23.

Figure 8:
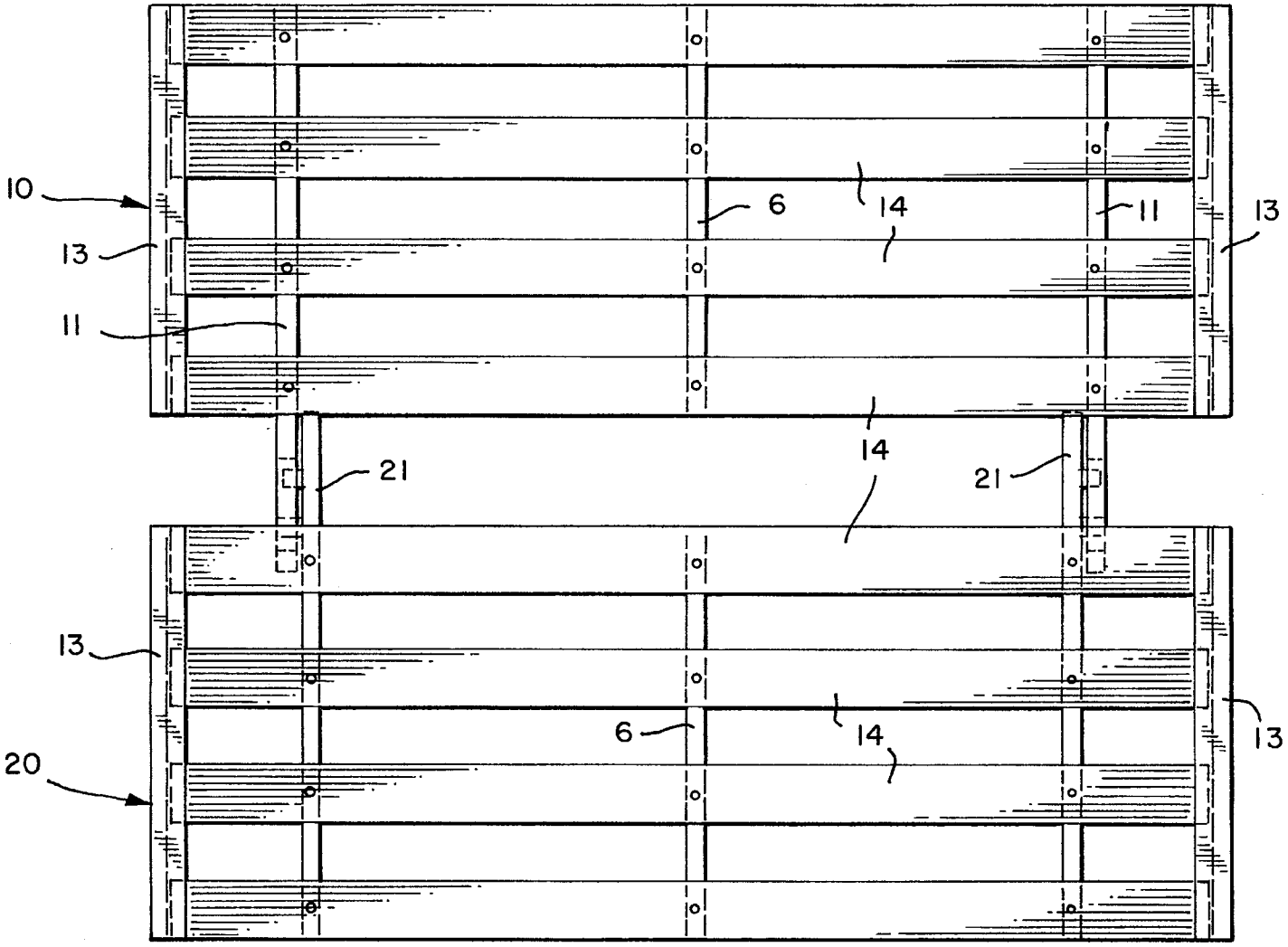
FIG. 8 is a top plan of FIG. 7 with the seat frame assembly and back frame assembly interlocked.

As shown in FIG. 7, a movement of the seat frame assembly 10 in the direction of arrow E locks the support beam 11 between the pin 22 and the slats 14 of back frame assembly 20 as can be seen in plan view in FIG. 8. The cambered portion 16 of the support beam 11 cams on the pin 22 and causes a locking engagement under a slat 14.

This locking engagement maintains the seat frame assembly 10 and back frame assembly 20 in their respective positions and also serve to prevent jackknifing of the sofa bed recliner 1 when in use in a horizontal position.

Figure 10:
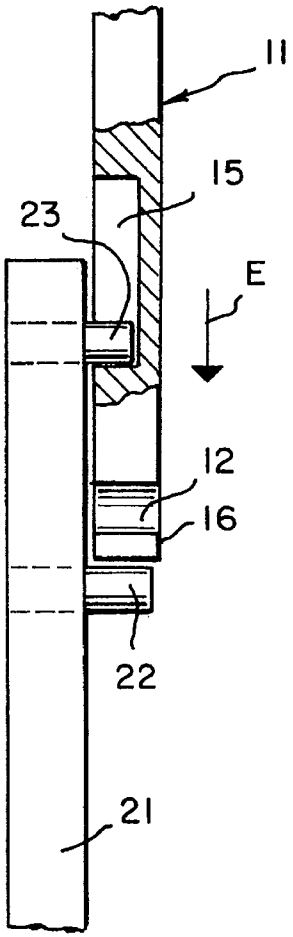
FIG. 10 is a detail, partially sectioned, plan view of FIG. 7 showing the seat frame support beam and back frame support beam disengaged.
Figure 11:
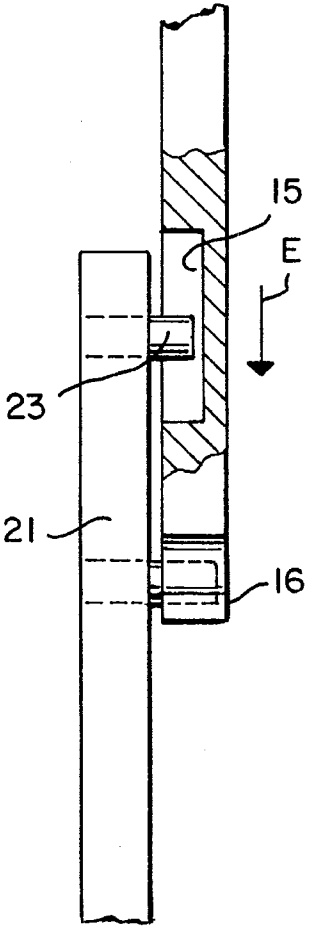
FIG. 11 is a detail, partially sectioned, plan view of FIG. 10 showing the seat frame support beam and back frame support beam interlocked.

As shown in FIGS. 10 and 11, the pin 23 in the groove 15, when moved in the direction of arrow E, cams on the cambered portion 16 of the support beam 11, giving an upward thrust for the locking engagement, as indicated in FIG. 7, as can be seen in FIG. 8.

Support beams 6 span the seat frame assemblies 10 and back frame assemblies 20, to rigidize the slats 14.

They may (not shown) be shaped to conform to the their respective support beam 11 and 21, so that they can rest on the floor 2.

The reconversion from the sofa bed horizontal position is a reversal of the conversion steps. The seat frame assembly 10, as shown in FIG. 7, is withdrawn in the direction opposite that of arrow F. The seat frame assembly 10 then is lifted in the direction opposite that of arrow D. The cambered portion 16 of the support beam 11 rotates about pin 23 and cams against pin 22 until the seat frame assembly 10 is vertical and the pin 22 is beyond the top of the support beam 11.

At that point, the seat frame assembly 10 assembly drops downward in a direction opposite arrow C, guided by the groove 15.

At that point, the declivity 12 is engagable with the pin 22, as shown in FIG. 5, moving in the direction opposite arrow B. As shown in FIG. 4. The sofa bed recliner 1 is then rotatable in the direction opposite arrow A and is reverted to its recliner position, as shown in FIG. 3.

Once back in this position, the optional arm rest 30 may be engaged with the horizontal detent 34, engaged between two slats 14 of the back frame assembly 20 and the vertical detent 35 engaged between two slats 14 of the seat frame assembly 10.

The terms and expressions which are employed are used as terms of description; it is recognized, though, that various modifications are possible.

It is also understood the following claims are intended to cover all of the generic and specific features of the invention herein described; and all statements of the scope of the invention which as a matter of language, might fall therebetween.

Having described certain forms of the invention in some detail, what is claimed is:

1. A sofa bed recliner (1) having a sofa bed position and a recliner position comprising a seat frame (10); and a back frame (20), each said frame (10, 20) having a frame portion and at least two supports (11, 21), at least two said supports (11, 21) of each frame (10, 20) including a portion extending beyond said frame portion on the same side, at least two said extending portions of each frame (10, 20) overlapping and including interactive engagement means, said interactive engagement means including a first detent (22) and a second detent (23) on at least two said back frame extending portions; and retaining means including a groove (15); at least one interactive guide surface (16); and a declivity (12) all on at least two said seat frame extending portions.

2. The invention of claim 1 wherein said frame portion includes slat means (14), said interactive engagement means include interactive interlockable means, said interlockable means include said first detent (22); said interactive guide surface (16); and said slat means (14) when said sofa bed recliner is in sofa bed position.

3. The invention of claim 2 wherein said interactive interlockable means include said groove (15) and said second detent (23) between said at least two extending portions.

4. The invention of claim 1 wherein said seat frame (10) support (11) has a front portion and a rear portion, said rear portion including said extending portion, said seat frame (10) support (11) being tapered from said front portion to said rear portion.

5. The invention of claim 1 wherein said interactive guide surface (16) surface is a camber.

6. The invention of claim 1 wherein said back frame (20) support (21) has a front portion and a rear portion, said front portion including said extending portion, said extending portion including an angulated portion (24) to hold said back frame tilted rearward when said back frame rests on the floor when said sofa bed recliner (1) is in recliner position.

7. The invention of claim 1 wherein at least one of said frame portions includes slats (14).

8. The invention of claim 1 including at least one removable arm rest (30).

9. The invention of claim 8 wherein said at least one removable arm rest (30) includes means to engage said back frame (20) and means to engage said seat frame (10).

10. The invention of claim 9 wherein said frame portions includes slats (14) and said means to engage said back frame (20) and means to engage said seat frame (10) is engagable in said frame portions between said slats (14).

11. The invention of claim 9 wherein said means to engage said back frame (20) and means to engage said seat frame (10) are detents.

* * * * *